US009833044B2

(12) United States Patent
Baucom

(10) Patent No.: US 9,833,044 B2
(45) Date of Patent: Dec. 5, 2017

(54) CLEATED ARTICLE OF FOOTWEAR

(71) Applicant: NIKE, Inc., Beaverton, OR (US)

(72) Inventor: Jim Baucom, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 353 days.

(21) Appl. No.: 14/588,494

(22) Filed: Jan. 2, 2015

(65) Prior Publication Data

US 2016/0192742 A1 Jul. 7, 2016

(51) Int. Cl.
*A43C 15/16* (2006.01)

(52) U.S. Cl.
CPC ..... *A43C 15/161* (2013.01); *A43C 15/165* (2013.01); *A43C 15/167* (2013.01)

(58) Field of Classification Search
CPC .... A43C 15/161; A43C 15/165; A43C 13/167
See application file for complete search history.

(56) References Cited

U.S. PATENT DOCUMENTS

| | | | | |
|---|---|---|---|---|
| 2,276,887 A * | 3/1942 | Smith | A43C 15/161 36/59 R |
| 2,309,783 A | 2/1943 | Park | |
| 2,582,053 A * | 1/1952 | Merlin | A43C 15/161 36/59 R |
| 3,844,056 A | 10/1974 | Kwan | |
| 3,911,600 A | 10/1975 | Dassler | |
| 4,360,490 A | 11/1982 | Collins | |
| 4,472,098 A | 9/1984 | Kiefer | |
| 5,036,606 A | 8/1991 | Erich et al. | |
| 5,848,482 A | 12/1998 | Bathum | |
| 5,940,993 A | 8/1999 | Ronci | |
| 6,708,428 B2 * | 3/2004 | Chen | A43B 5/001 36/134 |
| 6,823,613 B2 * | 11/2004 | Kelly | A43C 15/161 36/127 |
| 8,201,348 B2 | 6/2012 | Kelly | |

(Continued)

FOREIGN PATENT DOCUMENTS

| | | |
|---|---|---|
| EP | 0171622 A1 | 2/1986 |
| GB | 2223394 A | 4/1990 |
| WO | 92/11781 A1 | 7/1992 |

OTHER PUBLICATIONS

International Search Report and Written Opinion dated Jan. 19, 2015 in PCT/US2015/54433.

*Primary Examiner* — Jila M Mohandesi
(74) *Attorney, Agent, or Firm* — Honigman Miller Schwartz and Cohn LLP; Matthew H. Szalach; Jonathan P. O'Brien

(57) ABSTRACT

An article of footwear may include an upper, a sole, and a removable cleat member. The sole may include at least one base member disposed in the sole, the base member including a fastener receiving portion, the fastener receiving portion may include at least one female thread. The cleat member may include a cleat body having a ground-engaging end and an opposite fastening end. A fastening portion is configured to extend from the fastening end of the cleat body. The fastening portion may engage with the fastener receiving portion of the base member, the fastening portion including a post and the thread including a draft angle. The thread of the cleat member may be configured to engage with the female thread of the base member.

20 Claims, 15 Drawing Sheets

(56) References Cited

U.S. PATENT DOCUMENTS

| | | | | |
|---|---|---|---|---|
| 2003/0188459 | A1 | 10/2003 | Kelly | |
| 2007/0157489 | A1 | 7/2007 | Wu | |
| 2007/0209239 | A1 | 9/2007 | Kelly | |
| 2012/0266490 | A1* | 10/2012 | Atwal | A43C 15/161 36/62 |
| 2012/0311888 | A1 | 12/2012 | Kelly | |
| 2013/0031807 | A1* | 2/2013 | Gerber | A43C 15/161 36/134 |
| 2014/0259764 | A1 | 9/2014 | Schoenleber | |

* cited by examiner

CLEATED ARTICLE OF FOOTWEAR

BACKGROUND

It is advantageous, when participating in various athletic activities, to have footwear that provides traction and stability. Accordingly, sole structures for articles of footwear have been developed with cleat members to provide traction on a variety of surfaces. In particular, articles of footwear with interchangeable or removable cleats have been developed for sports, such as football, soccer, rugby, baseball, and golf.

After a period of use, cleat members on an article of footwear can become worn down. In the past, this would require replacement of the entire shoe. Removable cleats on an article of footwear were developed so that worn down cleat members could be easily removed and replaced with new cleat members. Removable cleat members also allow the user to select varied sizes or lengths of cleat members depending on the playing surface or the user's preference.

Cleat members have been previously developed with a ground-contacting portion on the bottom and a threaded portion on the top. Threaded portions on cleat members have been provided with either a single start thread or multi-start thread.

Single start threads provide a strong connection. However, the high number of turns required to attach and detach the cleat member with a single start thread becomes extremely time consuming. Multi-start threads have a steeper thread angle which enables the cleat member to be attached and detached with less rotation. Additionally, a multi-start thread is deeper cut than a single start thread, making the shear strength of the thread greater, so a shorter thread post can be used. However, known multi-start threaded cleat members may require additional locking mechanisms to prevent accidental loosening or unscrewing of the cleat member from the article of footwear.

Additional locking mechanisms may increase the weight of the cleat member and therefore the overall weight of the article of footwear. When additional locking mechanisms are included, the seal between the cleat member and the sole of an article of footwear may be more susceptible to debris collection, the additional mechanisms may be more susceptible to damage, and the cleat members may be more costly to manufacture.

There exists a need in the art for a cleat member for an article of footwear that provides quick attachment and release with minimal rotation, resistance to accidental loosening, a complete seal from debris, and a lightweight profile.

SUMMARY

The present disclosure is directed to improvements in cleat systems for articles of footwear, including provisions for quick attachment and release of cleat members, resistance to accidental loosening of cleat members during use, and providing a seal from debris at the interface of cleat members and the sole of the article of footwear.

For example, the present invention may include a removable cleat system for an article of footwear. The removable cleat system may include a cleat member having a multi-start thread arrangement configured to be attached to a base member incorporated into the sole of the article of footwear. In some embodiments, the cleat member may include three multi-start threads, each thread extending approximately 120 degrees or less about a fastening portion of the cleat member. In addition, the threads of the cleat member may have a changing draft angle. In order to provide increased binding force, the female threads of the base member may have a substantially constant draft angle. The threads of the cleat member may also include textured surfaces to increase binding within the base member.

In one aspect, the present disclosure is directed to an article of footwear including an upper and a sole including at least one base member. The base member may include a fastener receiving portion, the fastener receiving portion including at least one female thread. The cleat member may include a cleat body, the cleat body including a ground-engaging end and an opposite fastening end. The cleat member may further include a fastening portion extending from the fastening end of the cleat body. The fastening portion may be configured to engage with the fastener receiving portion of the at least one base member, the fastening portion including a post and at least one thread that extends around the post. The thread of the cleat member may be configured to engage with the female thread of the base member.

In another aspect, the present disclosure is directed to a cleat system for an article of footwear. The cleat system may include a base member configured to be disposed in a sole of an article of footwear. The base member may include a fastener receiving portion. The fastener receiving portion may include at least one female thread. The cleat system may also include a cleat member including a cleat body. The cleat body may include a ground-engaging end and an opposite fastening end. A fastening portion may extend from the fastening end of the cleat body. The fastening portion may be configured to engage with the fastener receiving portion of the at least one base. The fastening portion may include a post and at least one thread that extends around the post. The thread may include a draft angle, wherein the thread of the cleat member is configured to engage with the female thread of the base member.

In another aspect, the present disclosure is directed to a cleat member for an article of footwear. The cleat member may include a cleat body including a ground-engaging end and an opposite fastening end. The cleat member may further include a fastening portion extending from the fastening end of the cleat body. The fastening portion may be configured to be removably engaged with a fastener receiving portion disposed on a base on a sole of the article of footwear. The fastening portion of the cleat member may include a post and at least one thread that extends around the post. The thread may further include a draft angle.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout different views.

DETAILED DESCRIPTION

Figure 1:
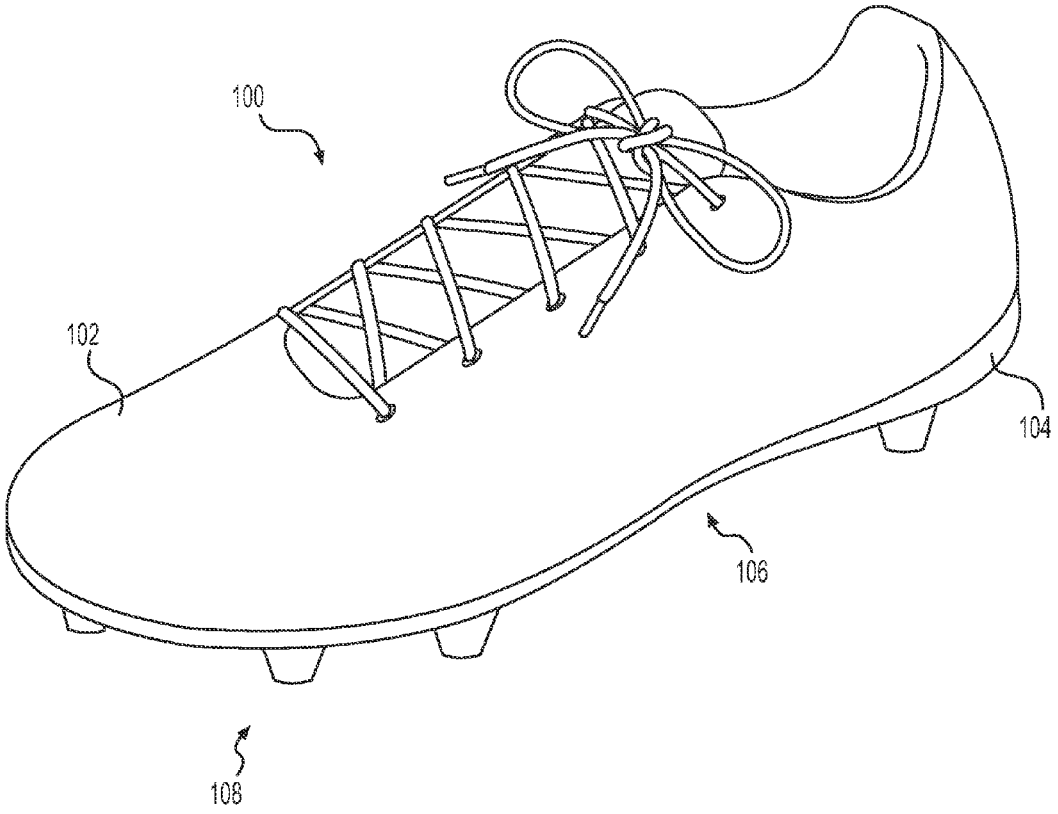
FIG. 1 is an isometric view of an exemplary embodiment of an article of footwear configured with cleat members.

FIG. 1 is an exemplary embodiment of an article of footwear 100. For clarity, the following detailed description discusses an exemplary embodiment, which may be suitable for use as a football shoe, but it should be noted that the present invention could take the form of any article of footwear including, but not limited to, soccer shoes, rugby shoes, baseball shoes as well as other types of shoes. As shown in FIG. 1, article of footwear 100, also referred to as footwear 100, is intended to be used with a left foot, however it should be understood that the following discussion may equally apply to a mirror image of article of footwear 100 that is intended for use with a right foot.

In some embodiments, article of footwear 100 may include one or more components. In an exemplary embodiment, footwear 100 may include an upper 102 configured to receive a wearer's foot, and a sole 104 secured to upper 102. For clarity, only a portion of upper 102 is shown in FIG. 1. Generally, upper 102 may be any suitable type of upper. In particular, upper 102 could have any design, shape, size, and/or color. For purposes of illustration, upper 102 is shown generally in this embodiment.

Sole 104 may be fixedly attached to a bottom portion of upper 102. In some embodiments, sole 104 may include one or more layers. For example, sole 104 may include an outsole, as shown in FIG. 1. Further, in some embodiments, the outsole may include multiple components and/or layers. For example, in some cases, the outsole may include one or more reinforcing plates, which may be part of a multi-layer outsole construction. In addition, although not shown in the figures, in some embodiments, sole 104 may include a midsole, which may provide cushioning and control of ground reaction forces. Further, in some embodiments, sole 104 may include an insole (also not shown), which may provide comfort, fit, and additional cushioning properties.

In some embodiments, sole 104 may include a ground-facing surface 106. Ground-facing surface 106 may be configured to contact ground surfaces, including, but not limited to dirt, natural grass, synthetic grass or turf, as well as other types of playing surfaces. Sole 104 may also include a foot-side surface (not shown) disposed on an opposite side of sole 104 than ground-facing surface 106. In an exemplary embodiment, the foot-side surface may be configured to contact a portion of upper 102, a midsole layer, and/or an insole layer of footwear 100.

Generally, each component of article of footwear 100 may be constructed of any suitable material. For example, one or more portions of sole structure may be constructed from any suitable material, including but not limited to elastomers, siloxanes, natural rubber, other synthetic rubbers, aluminum, steel, natural leather, synthetic leather, or plastics. Also, upper 102 may be made from any suitable material, including but not limited to, nylon, natural leather, synthetic leather, natural rubber, or synthetic rubber.

In some embodiments, the sole may include provisions for increasing traction with a ground surface. In some cases, the sole may include one or more cleat members to enhance traction with a ground surface. Generally, the term "cleat" or "cleat members", as used in this detailed description and throughout the claims, includes any provisions disposed on a sole for increasing traction through friction and/or penetration of a ground surface. Alternatively, a cleat or cleat members may also be known as a "stud" or as "stud members". Typically, cleat members may be configured for particular uses, including but not limited to, football, soccer, baseball, rugby, golf or any type of activity that requires traction.

Figure 2:
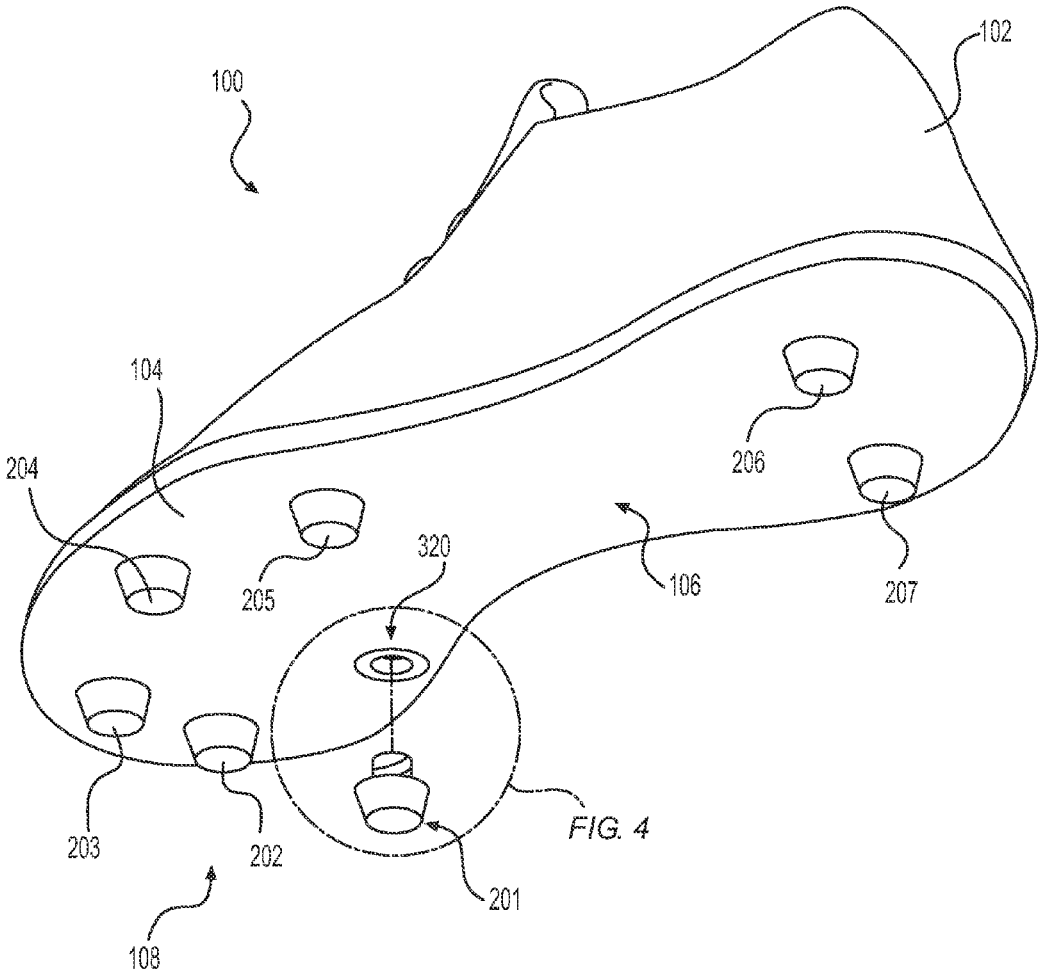
FIG. 2 is a bottom perspective view of an exemplary embodiment of an article of footwear configured with cleat members.

FIG. 2 illustrates a bottom view of an exemplary embodiment of footwear 100 including cleat members. As shown in FIG. 2, in some embodiments, footwear 100 may include a plurality of cleat members 108. For example, cleat members 108 may include a first cleat member 201, a second cleat member 202, a third cleat member 203, a fourth cleat member 204, a fifth cleat member 205, a sixth cleat member 206, and a seventh cleat member 207.

Footwear 100 may include any suitable number of cleat members 108 provided on sole 104. In addition, cleat members 108 may be positioned in any suitable arrangement on sole 104. As shown in FIG. 2, cleat members 108 may be disposed in one or more regions of footwear 100, including one or more of a forefoot region, a mid-foot region, and/or a heel region. In some embodiments, first cleat member 201, second cleat member 202, third cleat member 203, fourth cleat member 204, and fifth cleat member 205 may be located in a forefoot region of footwear 100, as shown in FIG. 2. In addition, in some embodiments, sixth cleat member 206 and seventh cleat member 207 may be located in a heel region of footwear 100, as also shown in FIG. 2.

In some embodiments the footwear may include a customizable sole. For example, one or more of the cleat members may be removable from the sole. Providing cleat members that are removable may enable the wearer to replace worn down cleat members. In addition, cleat members of one size and configuration may be exchanged for cleat members having a different size and/or configuration. This may enable the wearer to choose cleat members to suit the conditions from game to game. The wearer may make the selection based on a variety of factors. For example, in some cases shorter cleat members may be selected for firm and/or dry surfaces, whereas longer cleat members may be selected for soft and/or wet surfaces. Other factors may also be considered when selecting cleat members for game-to-game use. In order to provide the cleat members with removability, the footwear may include a fastening system. The fastening system may include fastener features on the cleat member and associated with the sole. For example, in some embodiments, the cleat members may be removably attached to the sole using threaded connections.

In some embodiments, one or more of cleat members 108 may be removably attached to sole 104, for example, using fasteners that are configured to be engaged with corresponding receiving elements within sole 104. For example, in some embodiments, footwear 100 may include a cleat system. For example, as shown in FIG. 2, the cleat system may include first cleat member 201. In addition, the cleat system may also include a base member 320 disposed in sole 104 and configured to receive first cleat member 201. The cleat system, including first cleat member 201 and base member 320, is discussed in greater detail below.

In some configurations the footwear may include provisions to reduce weight and simplify construction. For example, in some embodiments, only the cleat members that are more frequently desired to be interchanged may be removable, and the other cleat members on the footwear may be integrally formed with the sole. In some cases, the cleat members that are more frequently desired to be changed may be in the forefoot region. In other cases, the cleat members that are more frequently desired to be changed may be in the heel region. This variance in the frequency with which cleat members are desired to be changed may be related to multiple factors. In some cases, cleat members in one region of the footwear may wear down more quickly. Additionally, or alternatively, cleat members in certain regions of the footwear may be more desirable to be changed to a different size and/or configuration depending on the field conditions.

While one or more of cleat members 108 may be removable, plurality of cleat members 108 may also include one or more cleat members that are integrally formed with sole 104. That is, in some embodiments, sole 104 may include one or more integral cleat members and one or more removable cleat members. For example, in some cases, cleat members in the forefoot region may be removable and cleat members in the heel region may be integrally formed with sole 104. For instance, first cleat member 201, second cleat member 202, third cleat member 203, fourth cleat member 204, and fifth cleat member 205 may be removably attached to sole 104, while sixth cleat member 206 and seventh cleat member 207 in the heel region may be integrally formed with sole 104. In other cases, cleat members in the forefoot region may be integrally formed with sole 104 and cleat members in the heel region may be removable. For example, in some embodiments, first cleat member 201, second cleat member 202, third cleat member 203, fourth cleat member 204, and fifth cleat member 205 may be integrally formed with sole 104 and sixth cleat member 206 and seventh cleat member 207 may be removably attachable to sole 104.

Since the footwear may include any suitable number of cleat members, the sole may include a corresponding number of base members to receive any number of removable cleat members. In some embodiments, each of the removable cleat members may be engaged with a base member on the sole. Accordingly, base members on a sole may be arranged in any particular design or pattern on any portion of a sole. Particular arrangements of base members and corresponding cleat members may be associated with different sports or different player positions within a sport. As shown in FIG. 2, a plurality of cleat members 108 may be releasably attached to the sole 104. Accordingly, a corresponding number of base members may also be arranged on a forefoot region and/or a heel region of the sole, as shown. In other embodiments, base members may be disposed in other suitable patterns.

Figure 3:
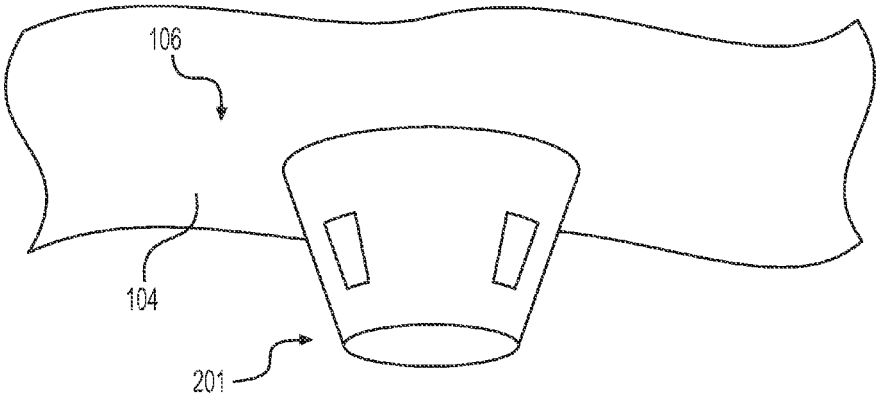
FIG. 3 is an enlarged view of an exemplary embodiment of a cleat member configured to releasably attach to a base member disposed in a sole of an article of footwear.

Referring now to FIG. 3, first cleat member 201 is illustrated as installed in ground-facing surface 106 of sole 104. For example, as shown in FIG. 3, first cleat member 201 may be screwed into a base member disposed in sole 104. The installation of first cleat member 201 in the base member is described in greater detail below.

Figure 4:
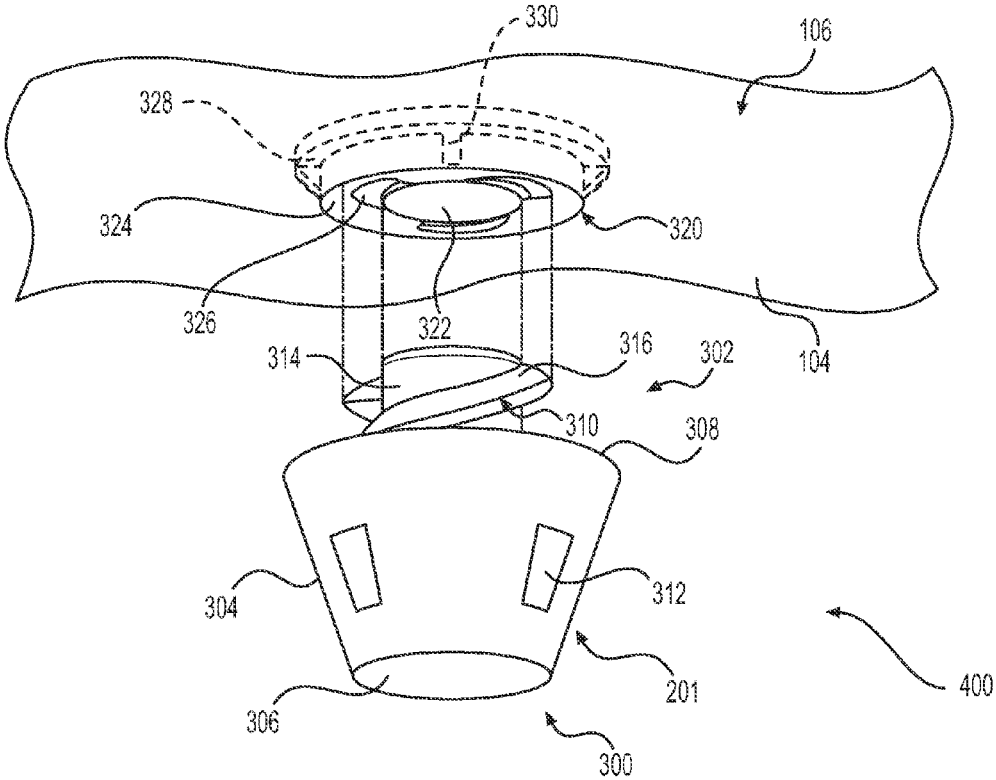
FIG. 4 is an exploded view of an exemplary embodiment of a cleat member configured to releasably attach to a base member disposed in a sole of an article of footwear.

FIG. 4 illustrates an exploded view of an exemplary embodiment of first cleat member 201 and base member 320. In this embodiment, first cleat member 201 is configured to releasably attach to a fastener receiving portion 322 disposed within base member 320 in sole 104. While FIG. 4 illustrates the attachment of first cleat member 201 to fastener receiving portion 322, it should be understood that the remaining plurality of cleat members 108 may be attached in a substantially similar manner to additional fastener receiving portions disposed within additional base members of sole 104.

As shown in FIG. 4, first cleat member 201 includes a cleat body 304 having a ground-engaging end 300 and an opposite fastening end 302. Ground-engaging end 300 is configured to contact a ground surface. Fastening end 302 may be located towards the point of attachment between cleat 200 and base member 320. Ground-engaging end 300 is disposed at a portion of cleat member 200 that is located further from ground-facing surface 106 of sole 104, when first clear member 201 is installed in sole 104. Fastening end 302 is disposed at a portion of cleat member 200 that is located proximate to ground-facing surface 106 of sole 104.

In some embodiments, for example, as shown in FIG. 4, cleat body 304 may have a generally truncated conical shape. In other embodiments, cleat body 304 may have other shapes. In the embodiment shown in FIG. 4, first cleat member 201 includes a ground-engaging portion 306 that is disposed at ground-engaging end 300 of cleat member 200. Ground-engaging portion 306 of cleat member 200 may be configured to contact and/or penetrate a ground surface.

In some embodiments, first cleat member 201 may include a lip 308. For example, as shown in FIG. 4, lip 308 may be a portion of cleat body 304 disposed adjacent to fastening end 302. In an exemplary embodiment, lip 308 may define an outer periphery of cleat body 304 of first cleat member 201. In cases where cleat body 304 has a generally truncated conical shape, lip 308 may be associated with a wider portion of cleat body 304. Ground-engaging portion 306 may be associated with the narrower portion of cleat body 304. In other words, cleat body 304 may taper from a wider portion associated with lip 308 to a narrower portion associated with the ground-engaging portion 306.

The cleat body may have additional provisions to facilitate installation and removal of the cleat member from the sole. For example, the cleat body may include provisions for engaging a tool that may be used to attach the cleat member to an article of footwear. For instance, in some cases, cleat body may include one or more grasping portions. Generally, the grasping portions may be recesses disposed on the cleat body. Grasping portions may have any suitable size and shape. Examples of various shapes include, but are not limited to, rectangles, squares, circles, ovals, polygonal and irregular shapes, as well as any other type of shape. Additionally, the depth of grasping portions can vary. By using different shapes recessed with different depths, grasping portions may be configured to engage a tool to attach a cleat member to an article of footwear. The absence of material in the recess may reduce the weight of a cleat member.

As shown in FIG. 4, at least one grasping portion 312 may be disposed on cleat body 304. As further shown in FIG. 4, in an exemplary embodiment, grasping portion 312 may have a generally triangular shape. With this configuration, grasping portion 312 may engage a tool to secure first cleat member 201 to sole 104 of an article of footwear.

In some embodiments, cleat body 304 may be configured with multiple grasping portions that are substantially similar to grasping portion 312. In some embodiments, first cleat member 201 may include three grasping portions. In some cases, the grasping portions may be disposed in an approximately evenly-spaced configuration around cleat body 304. In other embodiments, a cleat member may include more or fewer grasping portions, which may be spaced evenly or unevenly around the cleat body of the cleat member.

As shown in FIG. 4, some embodiments, fastening portion 310 may extend outward from fastening end 302 of cleat body 304. Additionally, fastening portion 310 may be configured to releasably attach first cleat member 201 to fastener receiving portion 322 of base member 320 in sole 104. Generally, fastening portion 310 may be configured in any suitable manner to engage fastener receiving portion 322. In particular, fastening portion 310 may be configured with a diameter sufficient to engage and fit within fastener receiving portion 322.

In some embodiments, fastening portion 310 may include threading to engage fastener receiving portion 322. For example, as seen in FIG. 4, fastening portion 310 may include a post 314 and at least one thread 316 that extends around the post 314. Fastening portion 310 may be associated with any type of thread, including threads having various sizes and pitch diameters. In this arrangement, fastening portion 310 may be screwed into fastener receiving portion 322.

As discussed above, the sole on the article of footwear may be provided with features configured to receive the fastening portion of the cleat members. In some embodiments, the sole may include a base member that features provisions that are capable of quickly receiving a cleat member. For example, the base member may include at least one female thread and an opening that is capable of receiving a cleat member.

As shown in FIG. 4, base member 320 may be disposed in sole 104. In some embodiments, base member 320 may include fastener receiving portion 322 that is capable of receiving fastening portion 310 of cleat body 304. As shown in FIG. 4, fastener receiving portion 322 may include a thread opening 326 that is configured to receive at least one thread 316 on first cleat member 201. In an exemplary embodiment, fastener receiving portion 322 may include multiple thread openings that would accept a multi-start thread. The number of thread openings included on the base member may correspond directly to the number of threads on the cleat member. For example, in some embodiments, fastener receiving portion 322 may include three thread openings, as shown in FIG. 4, which may be configured to receive three threads of a cleat member.

In some embodiments, base member 320 may be integrally formed with sole 104. For example, in such embodiments, base member 320 may be formed by molding fastener receiving portion 322 into sole 104 or by machining the cavity defined by fastener receiving portion. Such a configuration may expedite manufacturing, simplify construction, and reduce weight by eliminating additional materials. Such a configuration may also provide increased strength since there is not a separate piece to become detached from sole 104.

In some embodiments, base member 320 may be formed of a separate piece of material. Such a separate piece of material may be attached to sole 104 in any suitable manner. For example, in some embodiments, base member 320 may be adhesively attached to sole 104. In some embodiments, base member 320 may be press-fit (i.e., friction-fit) within a recess in sole 104. In other embodiments, base member 320 may be co-molded with sole 104. Further, base member 320 may be attached to sole 104 using any other suitable method.

Forming base member 320 as a separate piece of material from sole 104 may provide flexibility with manufacturing, by enabling the use of varied configurations. In addition, it would enable base member 320 to be formed of a different material than sole 104. In some cases base member 320 may be formed of a stronger and/or more rigid material than sole 104, which may reinforce the anchor point of first cleat member 201. Alternatively, in some embodiments, base member 320 may be formed of a less rigid and/or more compressible material than sole 104. The reduced rigidity and/or increased compressibility may provide increased comfort and/or improved ground contact by enabling first cleat member to move axially with respect to sole 104 and/or to deflect horizontally with respect to sole 104.

In some embodiments, the base member may include one or more features that secure the base member within the sole. For example, in some embodiments, the base member may include a rim (or lip) that extends radially away, in a substantially horizontal direction, from an upper portion of the base member. By including a rim having a larger diameter compared to the lower portion of the base member, the rim may secure the base member within the sole by preventing the base member from being pulled out of the sole.

For example, as shown in FIG. 4, in some embodiments, base member 320 may include an upper rim 328 extending from an upper portion of base member 320. Upper rim 328 may be wider than the lower portion of base member 320. As shown in FIG. 4, base member 320 may include a bottom face 324, which may have a smaller size than upper rim 328. As shown in FIG. 4, bottom face 324 may be substantially aligned (e.g., flush) with, and in abutting engagement with, ground-facing surface 106 of sole 104. Accordingly, upper rim 328 may prevent the egress of base member 320 from the recess within sole 104 in which it lies.

In addition, base member 320 may also include one or more support members 330, which may be configured to reinforce base member 320. For example, as shown in FIG. 4, support members 330 may extend substantially radially from the main body of base member 320, which may reinforce the base member 320 overall. In addition, support members 330 may extend downward from upper rim 328, thus providing a reinforcing buttress between the main body of the base member 320 and the upper rim 328. This may strengthen upper rim 328.

Figure 5:
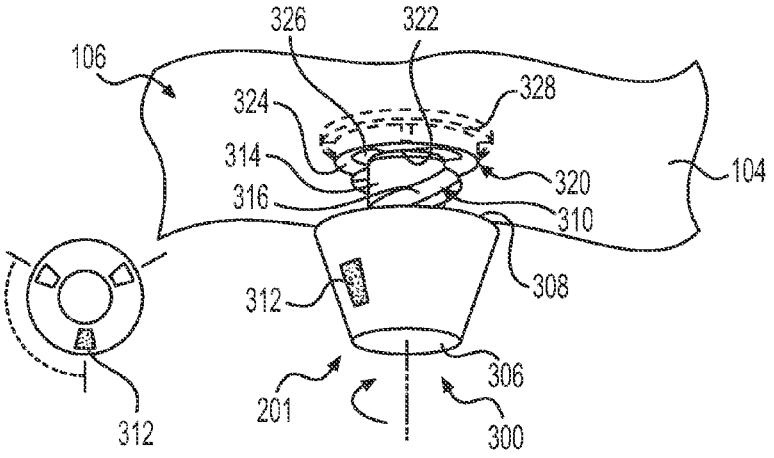
FIG. 5 is a representative view of an exemplary embodiment of a cleat member being releasably attached to a base member in a sole.
Figure 6:
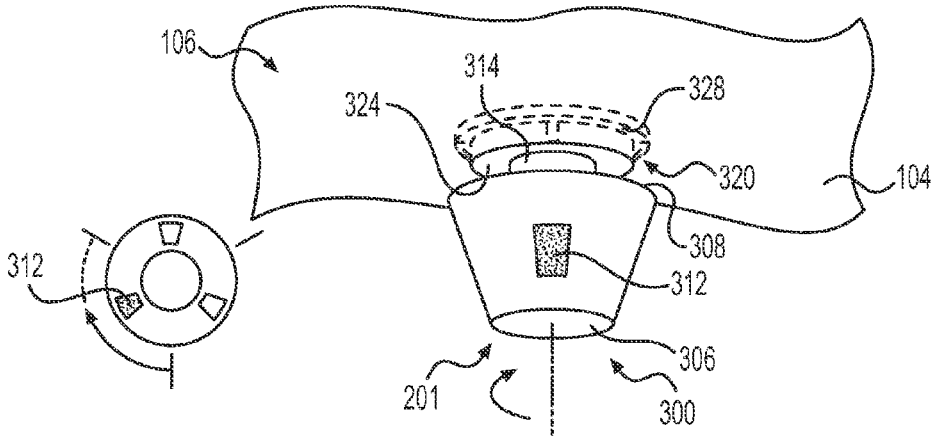
FIG. 6 is a representative view of an exemplary embodiment of a cleat member interlocking with a base in a sole.
Figure 7:
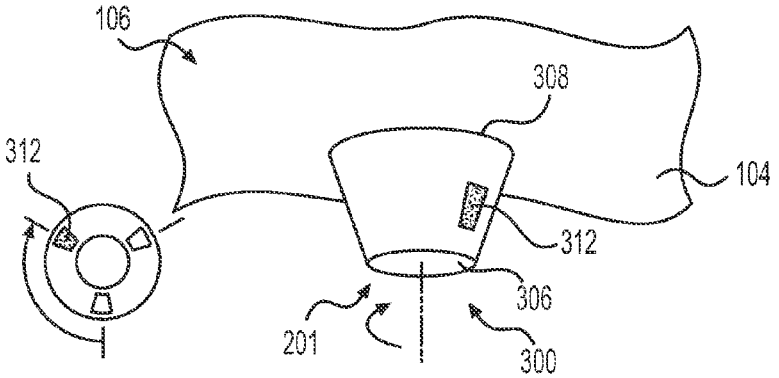
FIG. 7 is a representative view of an exemplary embodiment of a cleat member releasably attached to a base member with an interlocking arrangement.

The quick and secure attachment of a cleat member is beneficial to the user, especially when attaching or exchanging one or more cleat members on a sole. In some embodiments, the cleat member may be configured to be fully attached to the footwear in less than one complete turn (i.e., less than 360 degrees of rotation of the cleat member relative to the footwear). For example, in some embodiments, the cleat member may be configured to be fully attached to the footwear in less than approximately one half turn (i.e., 180 degrees). Further, in some embodiments, cleat members may be configured to be fully attached to a sole within approximately one-third turn (i.e., 120 degrees) or less. FIGS. 5 through 7 illustrate the progression of a cleat member interlocking with a base member in a sole of an article of footwear in approximately one-third turn. FIG. 5 shows the system just prior to engagement between the threads of the cleat member and the fastener receiving portion of the base member. FIG. 6 shows the cleat member partially engaged after approximately one sixth of a turn. FIG. 7 shows the cleat member fully engaged with the base member after another one sixth of a turn (one third turn total; i.e., approximately 120 degrees).

For purposes of this disclosure, the terms "fully attached," "fully installed," "fully engaged," "full engagement," "full attachment," and other such terms will be understood to mean that the cleat member is completely screwed in as far as it will go. In such condition, the binding of the cleat member to the footwear is at its peak and the footwear is in condition for use. Further, in such condition, an upper lip of the body portion of the cleat member is in contact with the base member or the lower surface of the sole.

In some embodiments, a tool (not shown) may be used to turn first cleat member 201 into base member 320 of sole 104. The tool may provide additional grip and torque for removal. In an exemplary embodiment, the tool may turn first cleat member 201 by engaging with one or more grasping portions 312. In FIGS. 5-7, grasping portion 312, which may be configured to receive a removal tool, is shaded for purposes of identification. Each of FIGS. 5-7 shows both a perspective view and a bottom view. The location of the shaded grasping portion 312 illustrates the various positions of first cleat member 201 during the rotational installation, including a starting point shown in FIG. 5, a mid-point shown in FIG. 6, and a final position shown in FIG. 7.

As shown in FIG. 5, fastening portion 310 is aligned with fastener receiving portion 322 at the starting position of the installation process. For reference, this is indicated by the initial position of grasping portion 312. Referring now to FIG. 6, first cleat member 201 is shown being screwed into base member 320 of sole 104. For reference, grasping portion 312 is shown midway between the initial position and a final position in both the perspective view and bottom view of FIG. 6. As shown in FIG. 7, first cleat member 201 is fully installed securely attached to base member 320 in sole 104. Accordingly, for reference, grasping portion 312 is shown in a final position in FIG. 7. In this exemplary embodiment, first cleat member 201 has been fully attached to base member 320 in approximately one-third turn (i.e., approximately 120 degrees of rotation about the central axis of first cleat member 201). With this fully attached arrangement, first cleat member 201 may resist becoming loose while the article of footwear is being worn.

Figure 8:
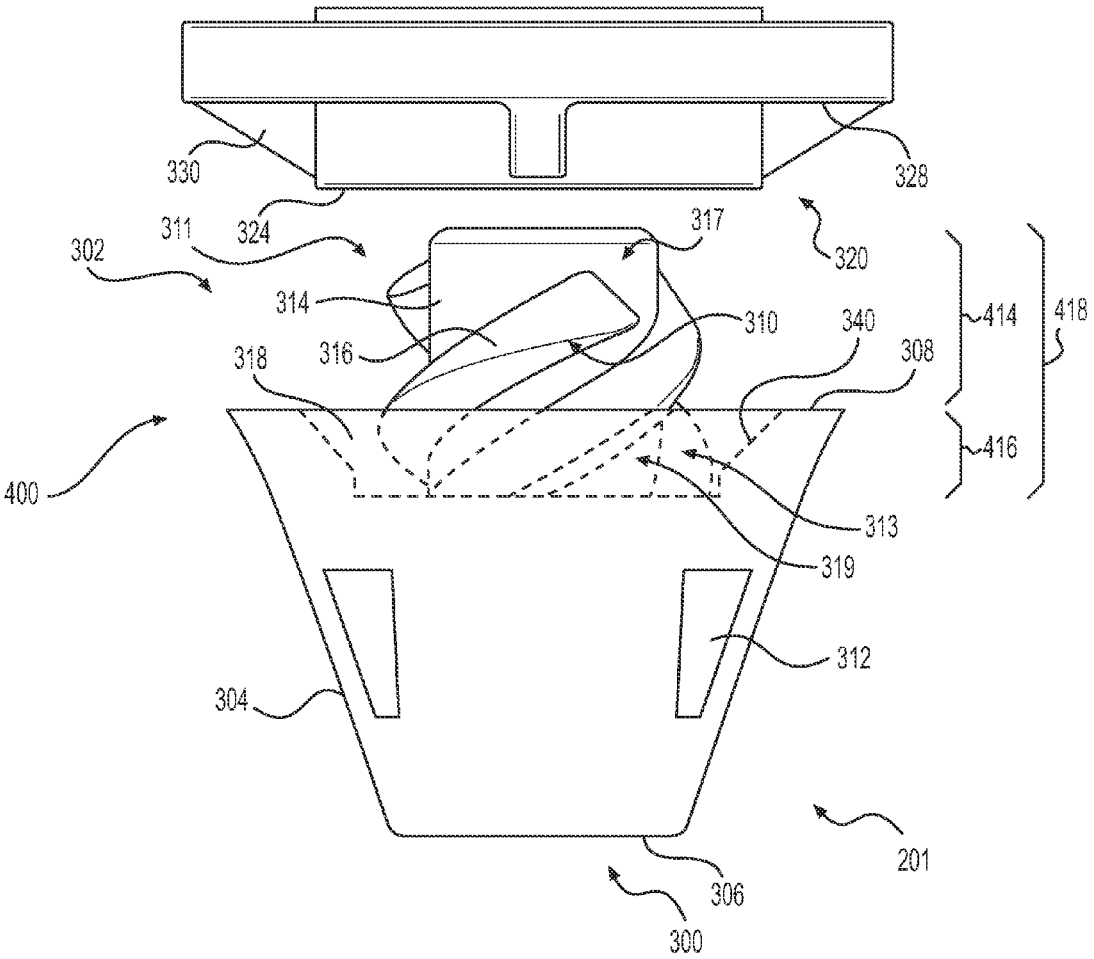
FIG. 8 is a schematic view of an exemplary embodiment of a cleat system.

FIG. 8 shows a schematic elevation view of cleat system 400. As shown in FIG. 8, post 314 of cleat member 200 may include a proximal end 317 located furthest away from ground-engaging end 306. In some embodiments, post 314 may also include a distal end 319 that is located opposite the proximal end 317 and closer to the ground-engaging end 306 of first cleat member 201. In some embodiments, thread 316 may include a first proximal end 311 and a second distal end 313. As shown in FIG. 8, the first proximal end 311 of thread 316 may be located at proximal end 317 of post 314. Further, second distal end 313 may be opposite first proximal end 311 and proximate to distal end 319 of post 314.

In some embodiments, cleat member may include provisions to reduce weight, increase binding force, increase durability, and prevent the introduction of debris between the cleat member and the footwear. For example, in some embodiments, a portion of the cleat body may be hollowed out around the post to form a recess. This structure may eliminate material from the cleat member, thus reducing weight. In addition, this absence of material may provide the outer lip of the cleat body with some flexibility. Due to this flexibility, the lip may deflect upon engagement with the sole or the base member. This deflection may increase the binding force between the components. In addition, this deflection may also provide a close fit, thus preventing the introduction of debris between the lip and the sole or base member. This arrangement also provides a shorter exposed fastening portion of the cleat member, thereby providing a shorter overall profile length of the cleat, which may increase durability.

As shown in FIG. 8, in some embodiments, first cleat member 201 may include a recess 318 extending around post 314. Recess 318 may be defined between post 314 and an angled interior wall 340 that extends at an inward angle towards post 314 from lip 308 of cleat body 304. Thus, fastening portion 310 of first cleat member 201 may include an upper exposed portion 414 and a recessed portion 406. Recessed portion 406 of fastening portion 310 may extend partially below lip 308 and may be surrounded by recess 318 of cleat body 304. Thus, the full length 418 of fastening portion 310 may be formed by exposed portion 414 and recessed portion 416, as shown in FIG. 8.

Figure 9:
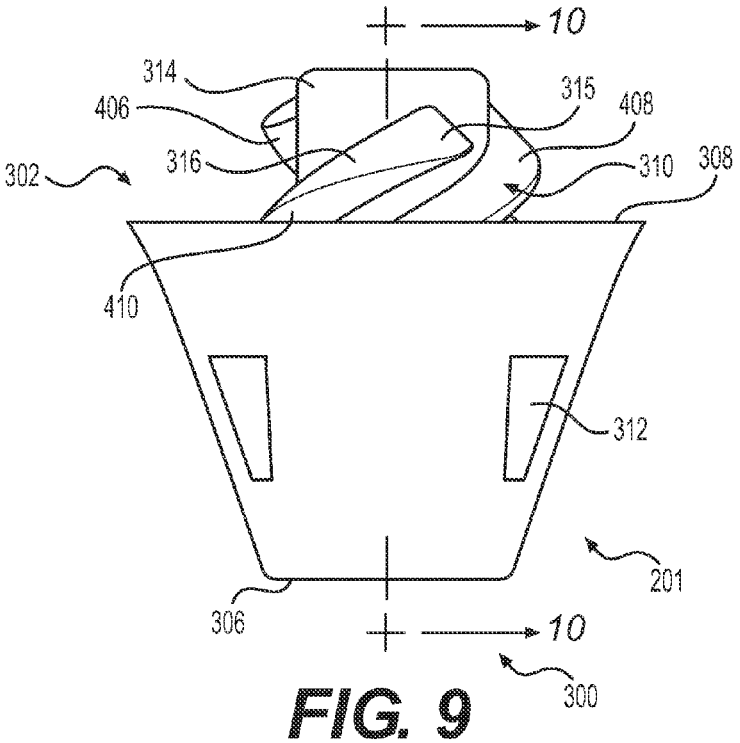
FIG. 9 is a side view of an exemplary embodiment of a cleat member.
Figure 10:
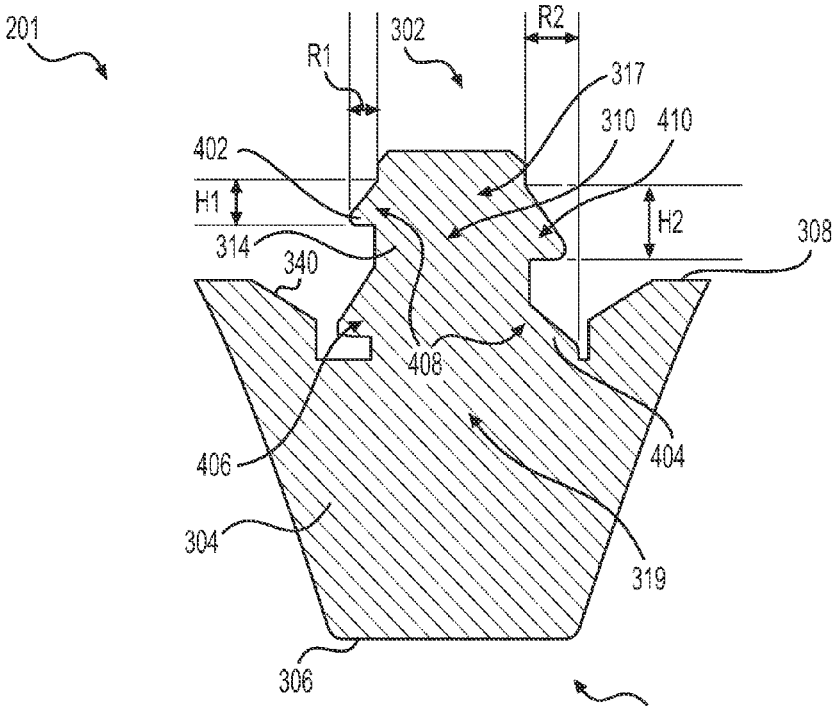
FIG. 10 is a cross-sectional view of an exemplary embodiment of a cleat member taken at section line 10-10 in FIG. 9.

FIGS. 9 and 10 illustrate similar views of first cleat member 201. FIG. 9 shows a side elevation view of cleat member 201, and FIG. 10 shows a cross-sectional view taken at section line 10-10 in FIG. 9. As shown in FIG. 10, in some embodiments, cleat body 304 and fastening portion 310 may be integrally molded. For example, the cleat body 304 and fastening portion 310 may be formed of a unitary piece of material. A cleat body of unitary construction may have greater strength than a cleat body that is formed from two different material elements joined together. A unitary cleat member may also be lighter weight. Unitary cleat members may also facilitate recycling, since the cleat member does not include different materials. However, in some embodiments, cleat body 304 and fastening portion 310 may be formed of separate pieces that are attached together. Two-piece cleat members may enable different materials to be used for the two components. Accordingly, materials may be more selectively chosen for their properties according to the desired characteristics of each component. For example, it may be desirable to utilize a relatively stronger material, such as a metal, for fastening portion 310, whereas it may be desirable to utilize a relatively lightweight material, such as plastic, for cleat body 304.

A cleat member may include provisions for quick attachment to a base member in an article of footwear. For example, in some embodiments, the cleat member may include a multi-start thread. Accordingly, the cleat member may include multiple threads. Each of the threads may have a relatively steep angle, and may extend less than a full revolution around the post of the cleat member.

As shown in FIG. 9, first cleat member 201 may include a multi-start thread 316. For example, fastening portion 310 of first cleat member 201 may include three threads, including a first thread 406, a second thread 408, and a third thread 410. In some embodiments, first thread 406, second thread 408, and third thread 410 may be spaced equally from one another.

Cleat members may be attached, as well as replaced, quickly when the length of the thread does not extend fully around the post of a cleat. As represented in FIG. 9, the threads may sweep around the post approximately 180 degrees. This forms a relatively steep thread, providing a large axial translation for a small amount of rotation. Accordingly, a 180 degree sweep around the post allows for quick attachment of the cleat member to the article of footwear. In such embodiments, the cleat member may be attached in approximately one-third of a turn (i.e., approximately 120 degrees of rotation of the cleat member). In some embodiments, the threads may each extend less than approximately 180 degrees around post 314. Further, in some embodiments, the threads may each extend no more than approximately 120 degrees around post 314. (This angular sweep of the threads is shown in further detail in FIGS. 12 and 13.)

In some embodiments, threads from the fastening portion may include features that lock the cleat in place and provide increased binding when the cleat is attached to the base member. For example, in some embodiments, the thread may include a draft angle, thereby giving the fastening portion of the cleat member an effective wedge-shape. That is, the thread may protrude from the post an increasing distance along the length of the thread. Thus, the more the cleat member is threaded into the fastener receiving portion of the base member, the tighter the thread may bind within the base member. To further increase the binding, the female thread of the fastener receiving portion may have a consistent depth, as opposed to a corresponding wedge-shape. Therefore, the wedge-shape of the male thread of the fastening portion of the cleat member may provide tight securement and increased binding of the cleat when inserted into the fastener receiving portion of the base member. Aspects of the interaction between the drafted thread of the cleat member and the female thread of the base member are discussed below with respect to FIGS. 10-20.

As noted above, FIG. 10 shows a cross-sectional view of the cleat member taken at section line 10-10 in FIG. 9. In some embodiments, fastening portion 310 may include at least one thread that may have a draft angle, thus making the thread wedge-shaped. As shown in FIG. 10, each of first thread 406, second thread 408, and third thread 410 may have a draft angle. (In other embodiments, one or more of the threads may not include a draft angle.) That is, each of first thread 406, second thread 408, and third thread 410 may extend further from post 314 the further away from fastening end 302 the threads extend. For example, as shown in FIG. 10, in some embodiments, second thread 408 may extend a first radial distance R1 from post 314 at one end of second thread 408 and a second radial distance R2 from post 314 at a second end of second thread 408. First radial distance R1 may be located at proximal end 402 of second thread 408 closest to fastening end 302 of first cleat member 201. Second radial distance R2 may be located at a distal end 404 of second thread 408 closest to ground-engaging end 300 of first cleat member 201. As shown in FIG. 10, first radial distance R1 may be smaller than second radial distance R2. Thus, the second radial distance R2 may be larger than first radial distance R1, thereby providing increased binding the further second thread 408 is inserted into the fastener receiving portion of the base member.

In addition, the threads may have a substantially triangular cross-sectional shape. Accordingly, due to the increasing extension of the threads from the post, not only does the radial distance increase along the length of threads, but also the height of threads may also increase along the length of threads. For example, as shown in FIG. 10, the beginning of second thread 408 may have a first height H1. Additionally, third thread 410 may have a second height H2 at a location that is distal to the location of height H1 of second thread 408. First height H1 may be located closest to fastening end 302 of first cleat member 201, while second height H2 may be located closer to ground-engaging end 300 of first cleat member 201.

Figure 11:
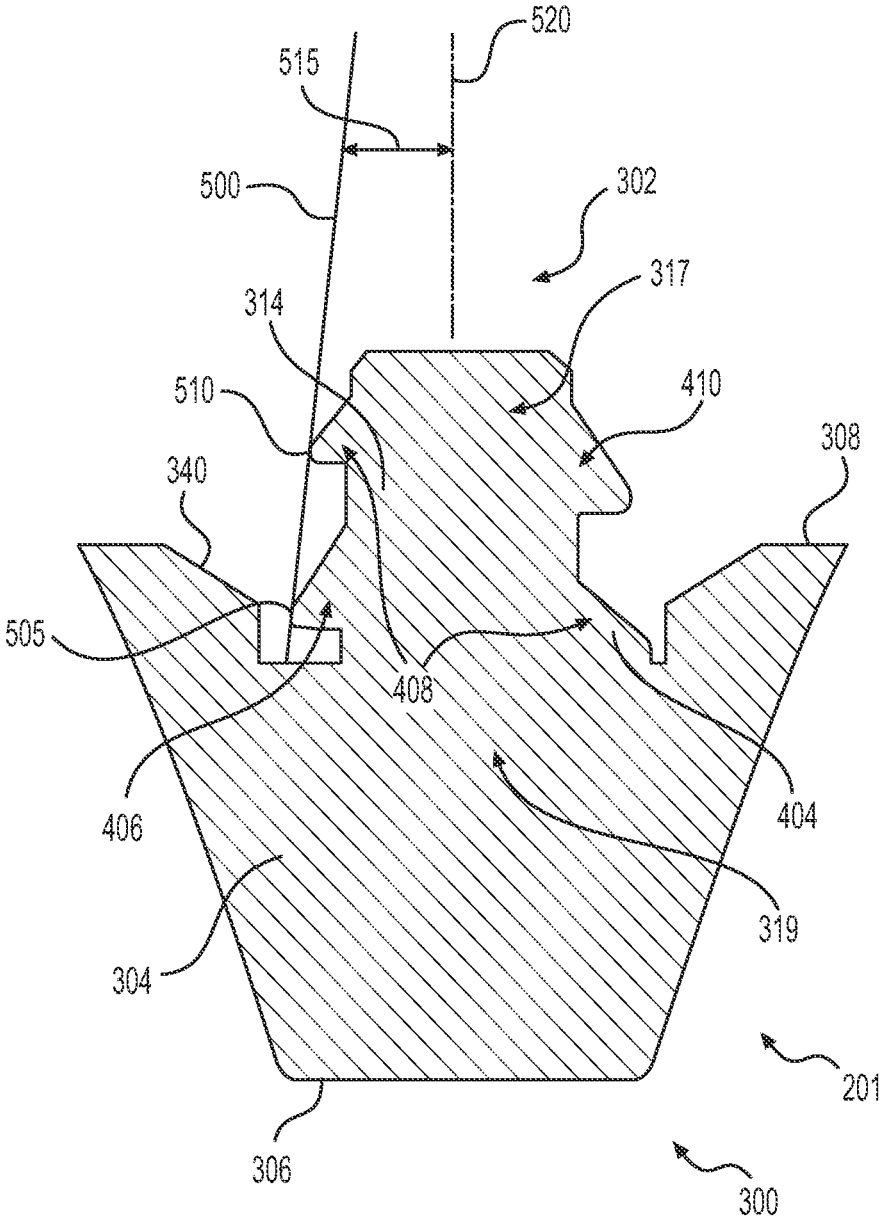
FIG. 11 is a cross-sectional view similar to FIG. 10, illustrating a draft angle of threads of a cleat member.

FIG. 11 illustrates the draft angle of the threads that is produced by the increasing radial distances discussed above. In particular, FIG. 11 shows a tangent line 500 in alignment with a first radial edge 505 of first thread 406 and second radial edge 510 of second thread 408. Tangent line 500 may form a draft angle 515 with a longitudinal axis 520 through first cleat member 201. Draft angle 515 may form a wedge-shape in which the radial edges of the threads are arranged in a conical configuration.

Draft angle 515 may have any suitable measurement. In some embodiments, draft angle 515 may be approximately 10 degrees. In other embodiments, draft angle 515 may be between about 5 degrees and about 10 degrees. In other embodiments, draft angle 515 may be less than about 5 degrees. For example, in some embodiments, draft angle 515 may be between approximately 1 degree and approximately 5 degrees. Further in some embodiments, draft angle 515 may be between about 3 degrees and about 5 degrees.

Figure 12:
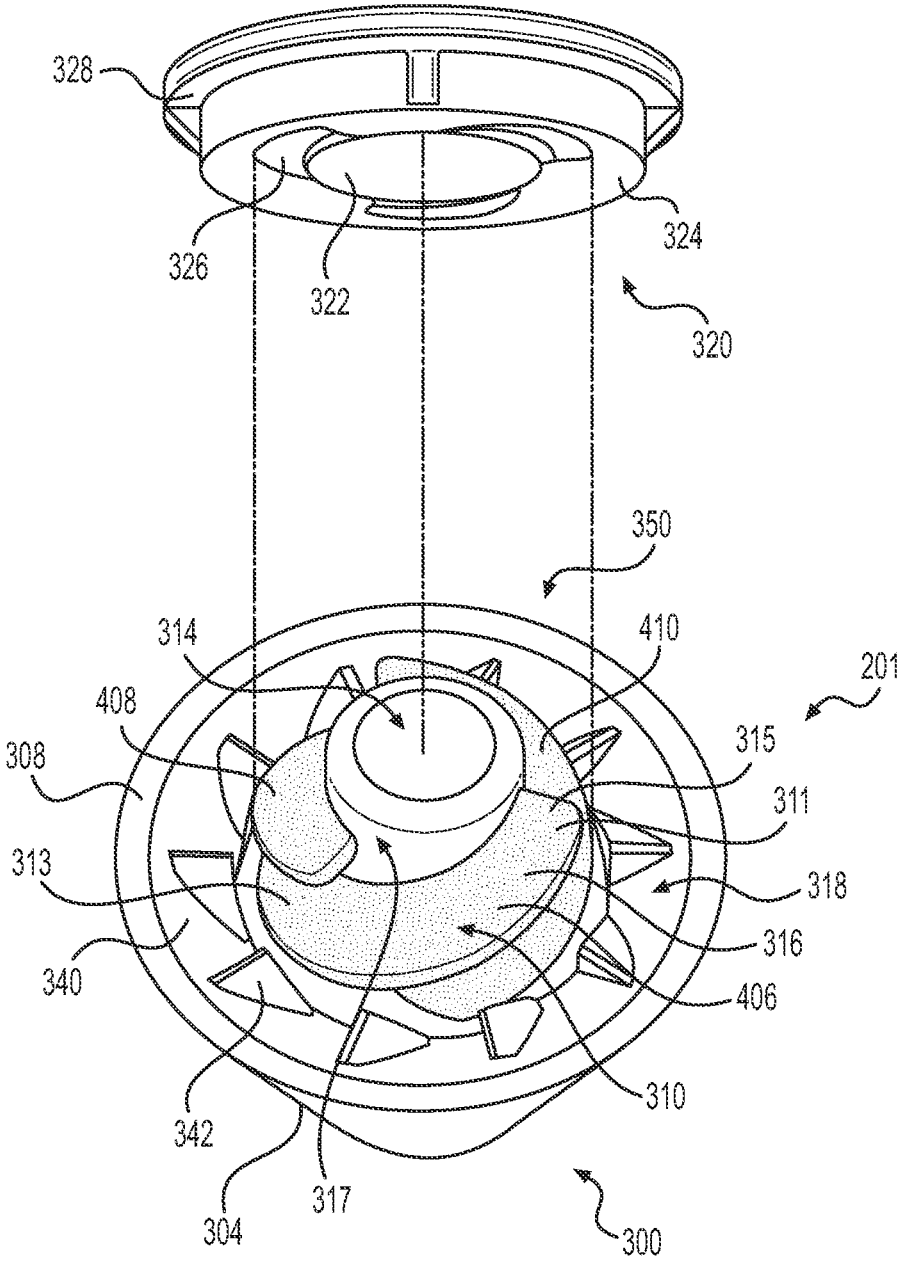
FIG. 12 is an exploded view of an exemplary embodiment of a cleat system including a cleat member and a base member configured for interlocking arrangement.

FIG. 12 illustrates an exploded view of the cleat system. In particular, FIG. 12 shows first cleat member 201 in a top perspective view and shows base member 320 in a lower perspective view, such that the cleat system is illustrated in a clam shell like arrangement. FIG. 12 illustrates several features of first cleat member 201 in more detail.

In some embodiments, the threads of the cleat member may include provisions to further increase binding upon insertion into the fastener receiving portion of the base member. For example, in some embodiments, one or more of the faces of the threads may include a texture. For example, in some embodiments, at least one of the threads may include a micro-texture. Micro-texture, or a surface that has been roughened, may assist in providing a tight fit to help prevent unintentional loosening of a cleat member from an article of footwear.

Stippled shading on first thread 406, second thread 408, and third thread 410 in FIG. 12 schematically illustrates texture on the surfaces of these threads. The texture may have any suitable surface roughness. The texture may be formed on the surfaces of the threads by any suitable method, such as bead blasting, sand blasting, machining, molding, coatings, or any other suitable technique.

In some embodiments, the cleat member may include additional features to provide reinforcement. For example, in some cases, the cleat member may include one or more fin elements extending from the inner wall of the cleat body within the recess around the post. These fin elements may provide reinforcement to the wall of the cleat body.

As shown in FIG. 12, first cleat member 201 may include at least one fin 342 in recess 318 along angled interior wall 340 of cleat body 304. In some embodiments, first cleat member 201 may include a plurality of fins 342, as shown in FIG. 12. Fins 342 may have any configuration suitable for reinforcing angled interior wall 340. For example, as shown in FIG. 12, in some embodiments, fins 342 may have a curved turbine-blade type configuration. This configuration may provide reinforcement against the torque applied during installation of first cleat member 201.

Figure 13:
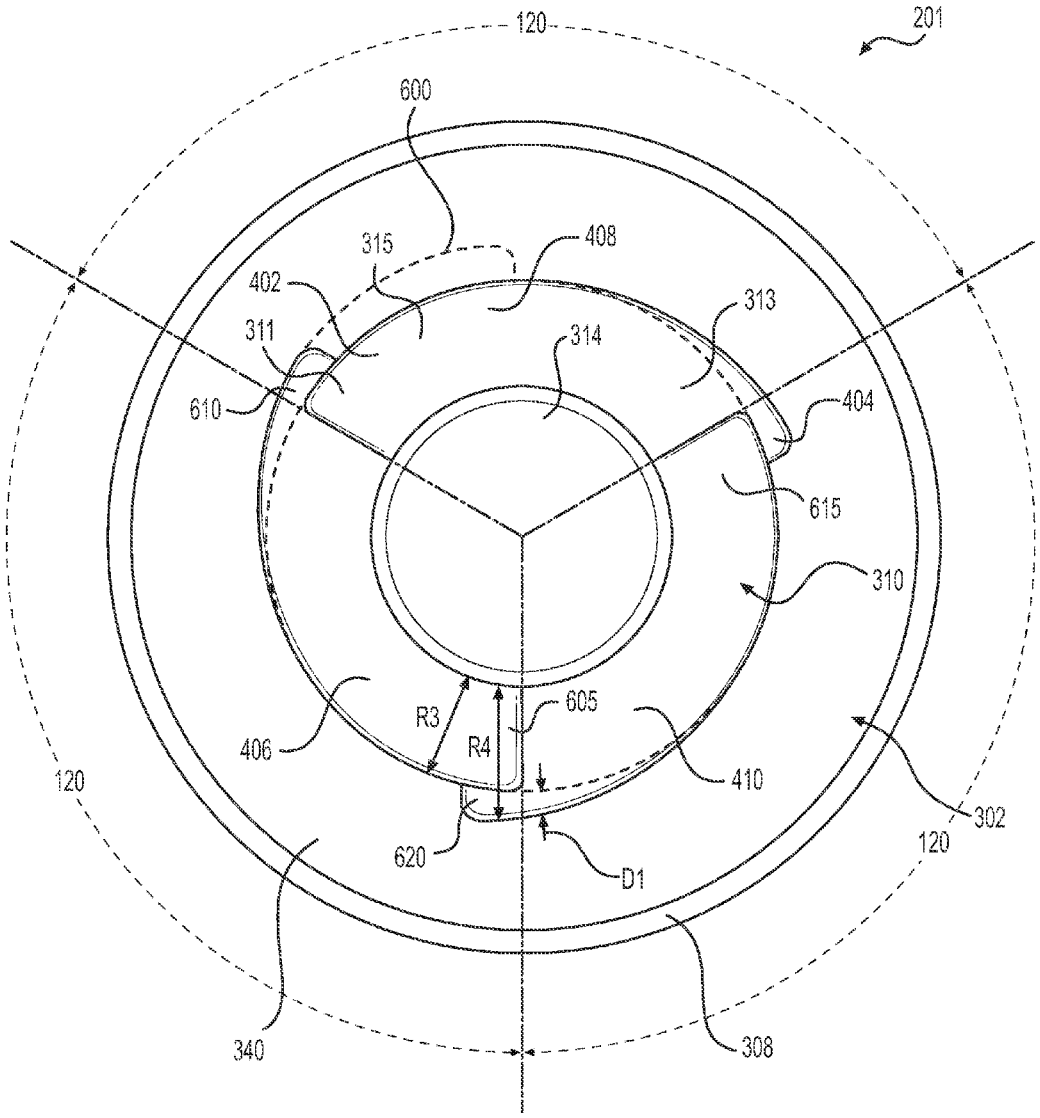
FIG. 13 is a top view of an exemplary embodiment of a cleat member.

FIG. 13 shows a top view of first cleat member 201. FIG. 13 illustrates two features discussed above, in greater detail. In particular, FIG. 13 shows the sweep of the threads, as well as the draft angle.

As discussed above, in some embodiments, the cleat member may have a thread that extends partially around the post. For example, at least one thread may extend less than approximately 180 degrees around the post 314. For example, as shown in FIG. 13, in some embodiments, first thread 406, second thread 408, and third thread 410 may extend less than approximately 120 degrees around post 314. Angle dimensions 120 shown in FIG. 13 illustrate the angular distance between the distal ends of the threads. As shown in FIG. 13, in some cases, the distal end of each thread may be located approximately 120 degrees from the proximal end. In some embodiments, at least one thread may extend approximately 180 degrees around post 314. For example, as illustrated by a dashed line 600, in some embodiments, the threads may extend approximately 180 degrees around post 314

As also discussed above, in some embodiments, the cleat member may include threads that have a draft angle causing the threads to have a different radius at one end of the thread than at the other end of the thread. As shown in FIG. 13, first thread 406 may extend from a first proximal end 605 to a first distal end 610. In addition, third thread 410 may extend from a second proximal end 615 to a second distal end 620. As shown in FIG. 13, first thread 406 may extend a first radial distance R3 from post 314 at first proximal end 605. As also shown in FIG. 13, third thread 408 may extend a second radial distance R4 at second distal end 620. The difference between beginning first radial distance R3 and second radial distance R4 is a radial difference D1. Due to radial difference D1, the draft angle of the threads assists in the tightening of the first cleat member 201 to the article of footwear as it is wedged into a female thread of the base member, causing the female thread to expand against the male thread.

FIGS. 14-20 further illustrate the wedging action of the threads due to the increasing thread thickness of the male threads of the cleat member when inserted into the female threads of the base member, which may have a constant thickness.

Figure 14:
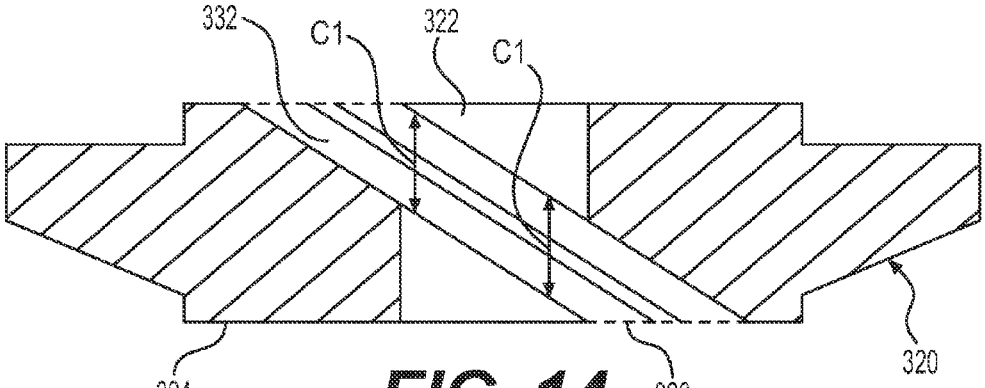
FIG. 14 is a cross-sectional view of an exemplary embodiment of a base member.

FIG. 14 shows a cross-sectional view of an exemplary embodiment of base member 320. As shown in FIG. 14, base member 320 may include a thread opening 326 that is capable of accepting at least one thread 316 of at least one cleat member 201. Base member 320 may also include at least one female thread 332 that extends from thread opening 326. In an exemplary embodiment, female thread 332 may maintain a constant female thread height C1 along the entire interior of thread 316, as shown in FIG. 14.

Figure 15:
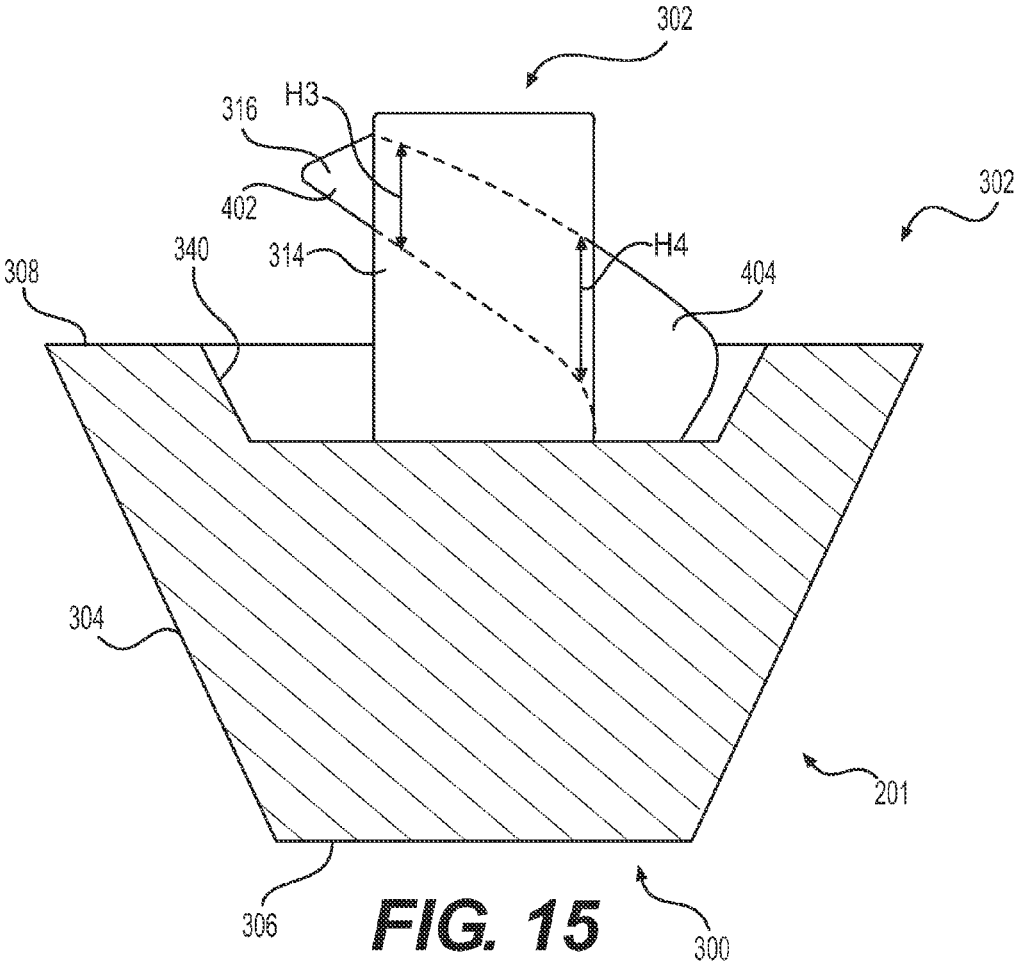
FIG. 15 is a cross-sectional view of an exemplary embodiment of a cleat member.

FIG. 15 shows a cross-sectional view of first cleat member 201. In this embodiment, only one thread is shown for purposes of illustration. However, it will be understood that first cleat member 201 may include more than one thread as shown in other figures. As discussed above, thread 316 of first cleat member 201 may include proximal end 402 and distal end 404. Proximal end 402 may be aligned with and inserted into thread opening 326 of base member 320. As shown in FIG. 15, proximal end 402 may include a first thread height H3 that is less than a second thread height H4 at distal end 404.

Once proximal end 402 of thread 316 is aligned with thread opening 326 and first cleat member 201 is turned, the increase in thread height of thread 316 helps provide a binding force that wedges the cleat thread into place.

Figure 16:
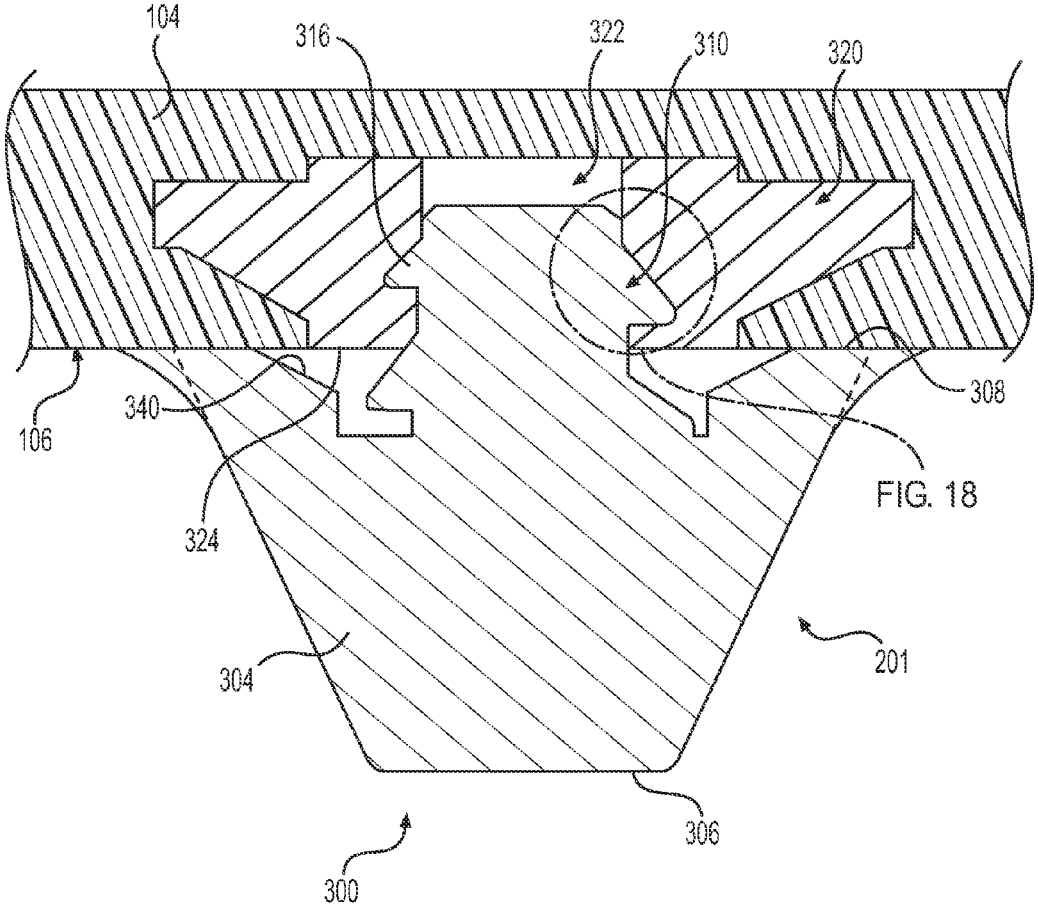
FIG. 16 is a cross-sectional view of an exemplary embodiment of a cleat member and a base member with an interlocking arrangement.

FIG. 16 shows a cross-sectional view of an assembled cleat system. As shown in FIG. 16, base member 320 is disposed within sole 104 of an article of footwear. In FIG. 16, first cleat member 201 is shown fully attached to base member 320. Accordingly, FIG. 16 further shows the threads of first cleat member 201 as being fully wedged into the female threads of base member 320 as far as the threads will go with lip 308 of cleat body 304 in contact with ground-facing surface 106 of sole 104.

Figure 17:
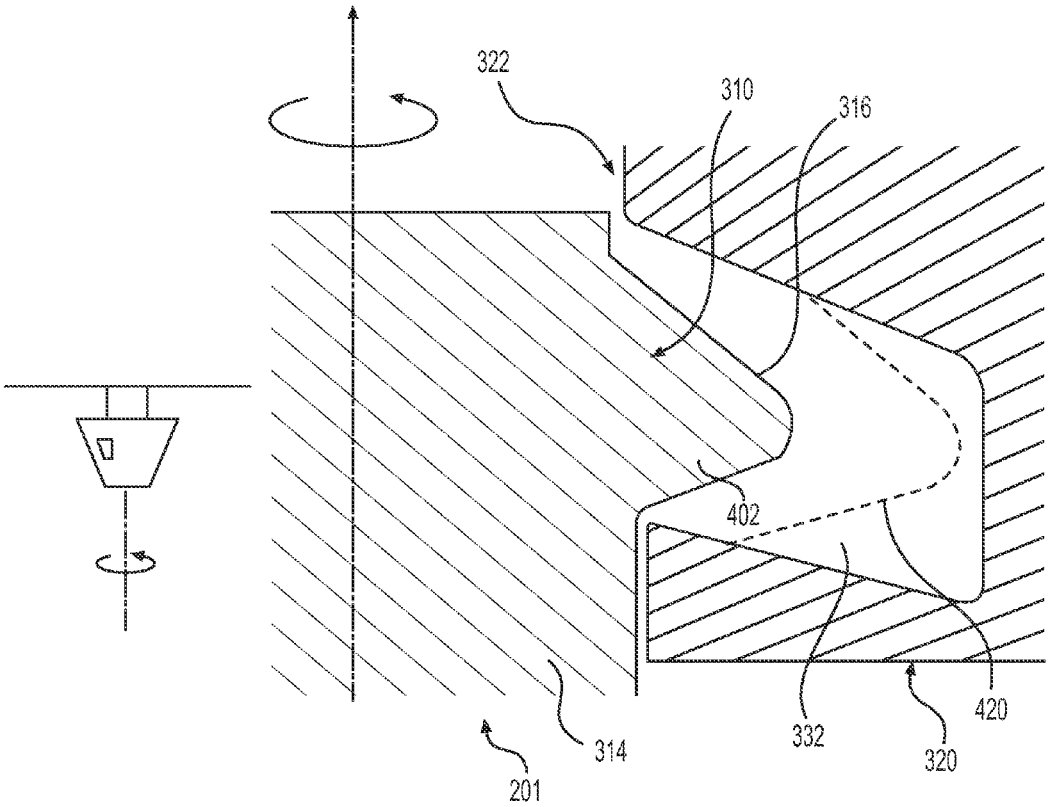
FIG. 17 is a partial cross-sectional view of an exemplary embodiment of a cleat member being releasably attached to a base member.
Figure 18:
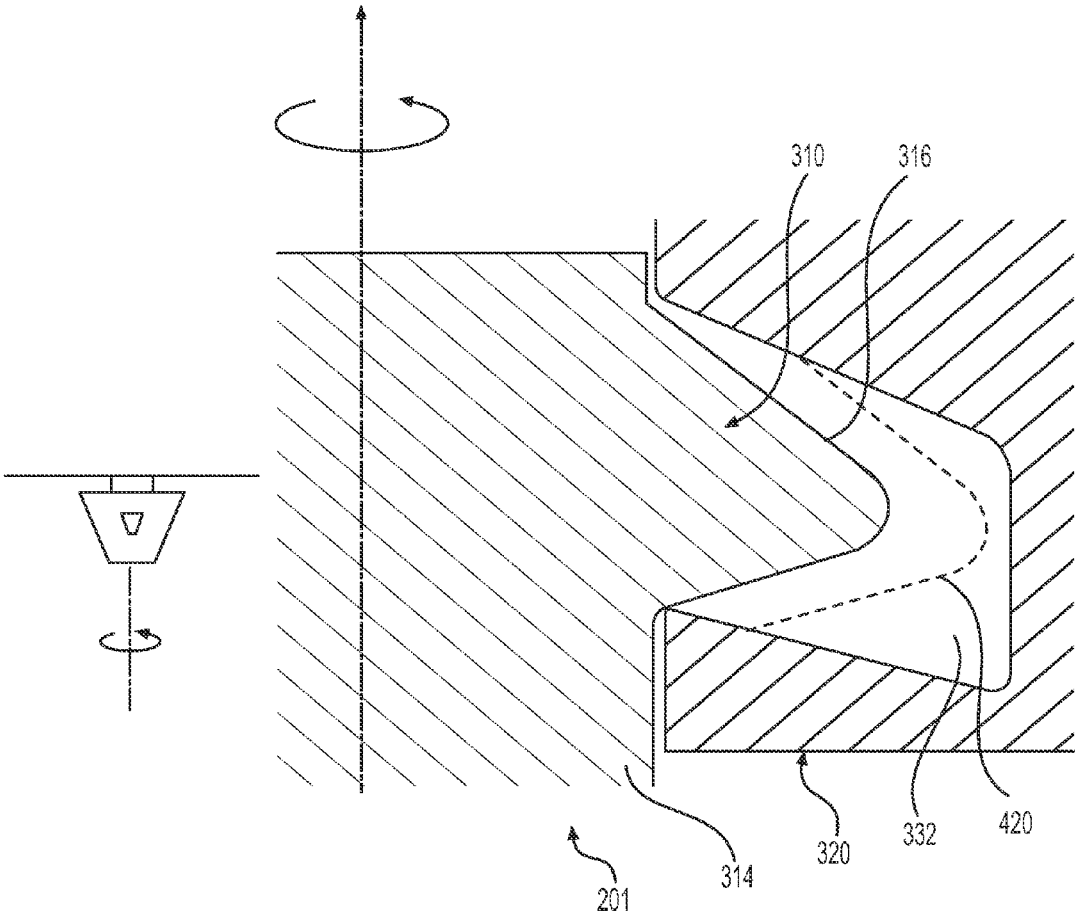
FIG. 18 is a partial cross-sectional view of an exemplary embodiment of a cleat member being releasably attached to a base member.
Figure 19:
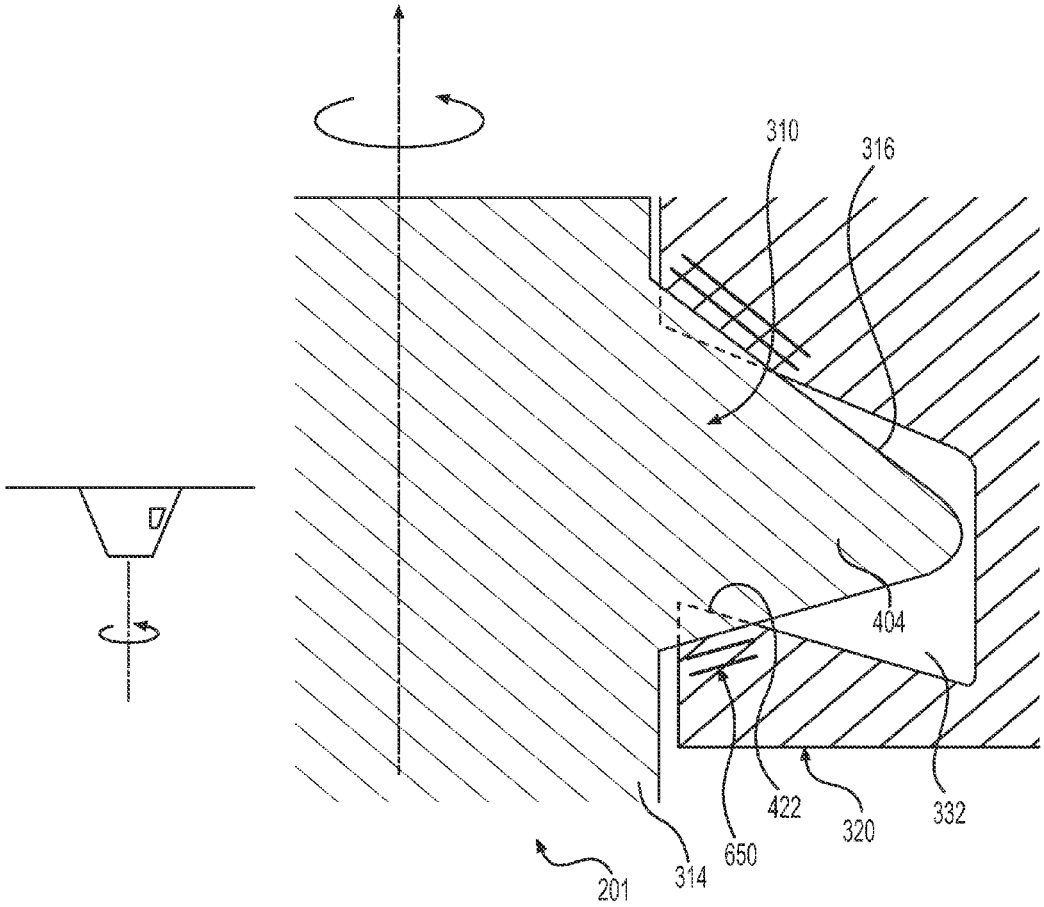
FIG. 19 is a partial cross-sectional view of an exemplary embodiment of a cleat member releasably attached to a base member in an interlocking arrangement.

FIGS. 17 through 19 illustrate different stages of a cleat member interlocking with a base member in a sole. The figures represent the progression of the cleat thread in relation to the female thread of the base member as the cleat member is screwed in place. In FIG. 17, fastening portion 310 of first cleat member 201 is shown as being inserted into fastener receiving portion 322 of base member 320. In the position shown in FIG. 17, the threads are aligned and first cleat member 201 turns freely, however, there is little if any binding between the threads. Proximal end 402 of cleat thread 316 is shown extending partially into female thread 332 of base member 320. FIG. 17 further shows a dashed reference line 420 illustrating the location of thread 316 upon full engagement with female thread 332.

In FIG. 18, first cleat member 201 is shown as having been screwed in part way such that thread 316 begins to bind with female thread 332 of base member 320. As shown in FIG. 18, thread 316 extends further horizontally into female thread 332, as illustrated by the reduced distance between thread 316 and reference line 420, which indicates the location of the thread at full engagement.

FIG. 19 shows first cleat member 201 fully engaged with base member 320. In FIG. 19, distal end 404 of cleat thread 316 is shown wedged into female thread 332 of base member 320. First cleat member 201 has been turned approximately one-third of a rotation from initial engagement between cleat thread 316 and female thread 332.

With cleat thread 316 in full engagement with female thread 332, binding may occur between the surfaces of the threads. For example, as shown in FIG. 19, the walls of female thread 332 may be deflected and/or compressed by the surfaces of cleat thread 316. A dashed line 422 indicates the original, uncompressed location of the wall of female thread 332. In addition, double lines 650 illustrate the compression of the wall of base member 320. It will be understood that the amount of compression of the wall is illustrated schematically in FIG. 19. As shown in FIG. 19, the draft angle of cleat thread 316, when engaged within the constant profile of the female thread, causes a binding force that wedges the cleat thread 316 into place.

Figure 20:
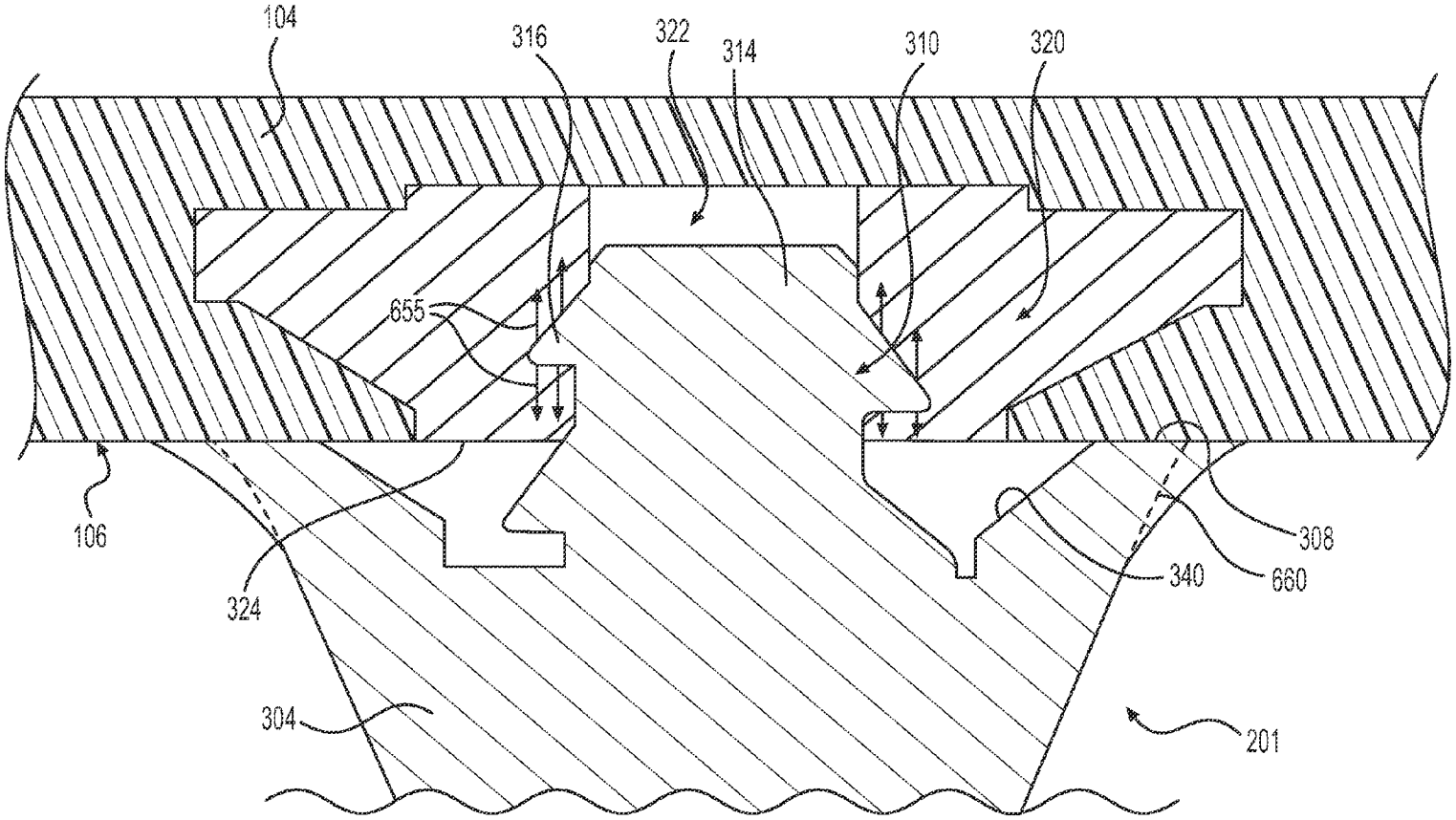
FIG. 20 is a cross-sectional view of an exemplary embodiment of a cleat member releasably attached to a base member in a sole of an article of footwear.

The forces that may be produced by the wedging effect of the draft angle of cleat thread 316 are shown in FIG. 20. As shown in FIG. 20, cleat thread 316 of first cleat member 201 may exert vertical forces on female thread 332 of the base member 320. These vertical forces are illustrated by arrows 655. These vertical forces may cause the expansion of female thread 332 by slightly compressing the walls of female thread 332 (see FIG. 19), thus producing additional binding forces that tightly lock the cleat in place. These forces help keep the cleat attached securely to the article of footwear.

In some embodiments, the cleat member may include provisions for preventing the introduction of debris between the engagement surfaces of the cleat body and the ground facing surface of the footwear sole. For example, in some embodiments, the seal between the cleat member and the sole may be augmented by deflection of the lip of the cleat body. This is beneficial because debris may wear down thread surfaces, which can decrease the strength and tightness of the hold between the cleat and base member.

As shown in FIG. 20, lip 308 at the outer periphery of cleat body 304 may be configured to flare outward upon full attachment of first cleat member 201 to base member 320. For example, as shown in FIG. 20, lip 308 may splay radially outward upon engagement with ground-facing surface 106 of sole 104. This deflection is illustrated by a dashed reference line 660, which shows the position of the outer surface of lip 308 before such deflection. This deflection provides a tighter seal at the interface between cleat body 304 and ground-facing surface 106 of sole 104, which may prevent debris from collecting between the threads of first cleat member 201 and base member 320. In some embodiments, the length of the post and the size/shape of the lip of the cleat body may be designed to enhance this deflection.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

an upper;

a sole including at least one base member, the base member including a fastener receiving portion, the fastener receiving portion including at least one female thread; and at least one cleat member including a cleat body, the cleat body including a ground-engaging end and an opposite fastening end, a fastening portion extending from the fastening end of the cleat body, the fastening portion configured to engage with the fastener receiving portion of the at least one base member, the fastening portion including a post and at least one thread that extends around the post, the thread including a draft angle;

wherein a first radial distance from an outer circumferential surface of the post to an outer circumferential edge of the thread at a first end of the thread is less than a second radial distance from the outer circumferential surface of the post to the outer circumferential edge of the thread at a second end of the thread;

wherein the thread of the cleat member is configured to engage with the female thread of the base member.

2. The article of footwear according to claim 1, wherein the thread of the fastening portion extends less than approximately 180 degrees around the post.

3. The article of footwear according to claim 1, wherein the thread of the fastening portion extends less than approximately 120 degrees around the post.

4. The article of footwear according to claim 1, wherein the thread of the fastening portion is a multi-start thread.

5. The article of footwear according to claim 1, wherein the fastening portion is configured to provide attachment of the cleat member to the base member in approximately one-third turn or less.

6. The article of footwear according to claim 1, wherein the at least one female thread includes at least one female thread having a constant profile.

7. The article of footwear according to claim 1, wherein the thread of the cleat member is configured to expand the female thread of the base member.

8. The article of footwear according to claim 1, wherein a lip is disposed around an outer periphery of the cleat body at the fastening end of the cleat member, the lip is configured to flare outward upon full attachment of the cleat member to the base member.

9. A cleat system for an article of footwear, the cleat system comprising;

a base member configured to be disposed in a sole of an article of footwear, the base member including a fastener receiving portion, the fastener receiving portion including at least one female thread; and a cleat member including a cleat body, the cleat body including a ground-engaging end and an opposite fastening end, a fastening portion extending from the fastening end of the cleat body, the fastening portion configured to engage with the fastener receiving portion of the base member, the fastening portion including a post and at least one thread that extends around the post, the thread including a draft angle;

wherein a first radial distance from an outer circumferential surface of the post to an outer circumferential edge of the thread at a first end of the thread is less than a second radial distance from the outer circumferential surface of the post to the outer circumferential edge of the thread at a second end of the thread;

wherein the thread of the cleat member is configured to engage with the female thread of the base member.

10. The cleat system according to claim 9, wherein the thread of the fastening portion extends less than approximately 180 degrees around the post.

11. The cleat system according to claim 9, wherein the thread of the fastening portion extends less than approximately 120 degrees around the post.

12. The cleat system according to claim 9, wherein the thread of the fastening portion is a multi-start thread.

13. The cleat system according to claim 9, wherein the thread of the cleat member is configured to expand the female thread of the base member.

14. The cleat system according to claim 9, wherein the at least one female thread includes at least one female thread having a constant profile.

15. The cleat system according to claim 9, wherein the fastening portion is configured to provide attachment of the cleat member to the base member in approximately one-third turn or less.

16. A cleat member for an article of footwear, the cleat member comprising:

a cleat body including a ground-engaging end and an opposite fastening end; and a fastening portion extending from the fastening end of the cleat body, the fastening portion configured to be removably engaged with a fastener receiving portion of a base disposed on a sole of the article of footwear, the fastening portion of the cleat member including a post and at least one thread that extends around the post, the thread including a draft angle;

wherein a first radial distance from an outer circumferential surface of the post to an outer circumferential edge of the thread at a first end of the thread is less than a second radial distance from the outer circumferential surface of the post to the outer circumferential edge of the thread at a second end of the thread.

17. The cleat member according to claim 16, wherein the thread of the fastening portion extends less than approximately 180 degrees around the post.

18. The cleat member according to claim 16, wherein the thread of the fastening portion extends less than approximately 120 degrees around the post.

19. The cleat member according to claim 16, wherein the thread of the fastening portion is a multi-start thread.

20. The cleat member according to claim 16, wherein the thread of the cleat member further includes a micro-texture.

* * * * *